US005713215A

United States Patent [19]

Choi

[11] Patent Number: 5,713,215

[45] Date of Patent: Feb. 3, 1998

[54] REFRIGERATOR HAVING QUICK FREEZING FACILITY

[75] Inventor: Woo-Yeop Choi, Kyeonggi-do, Rep. of Korea

[73] Assignee: Daewoo Electronics Co., Ltd., Seoul, Rep. of Korea

[21] Appl. No.: 739,712

[22] Filed: Oct. 29, 1996

[30] Foreign Application Priority Data

Oct. 31, 1995 [KR] Rep. of Korea ..... 95-39095

[51] Int. Cl.[6] ..... F25D 19/00

[52] U.S. Cl. ..... 62/455; 62/419

[58] Field of Search ..... 62/404, 407, 408, 62/419, 426, 440, 441, 454, 455

[56] References Cited

U.S. PATENT DOCUMENTS

| | | | |
|---|---|---|---|
| 2,735,277 | 2/1956 | Clark | 62/454 |
| 3,324,676 | 6/1967 | Gerweck | 62/419 |
| 5,048,306 | 9/1991 | Wakatsuki et al. | 62/419 |
| 5,285,655 | 2/1994 | Sung-Il et al. | 62/451 |
| 5,388,427 | 2/1995 | Lee | 62/331 |
| 5,588,305 | 12/1996 | Sim | 62/419 |

FOREIGN PATENT DOCUMENTS

| | | | |
|---|---|---|---|
| 403007876 | 1/1991 | Japan | 62/454 |

*Primary Examiner*—William Doerrler

*Attorney, Agent, or Firm*—Lowe, Price, LeBlanc & Becker

[57] ABSTRACT

A refrigerator having quick freezing facility is disclosed. The refrigerator includes a body, an evaporator, and a blowing fan. The body has freezing compartment which has a back wall formed with a plurality of cool air discharge openings. The evaporator is disposed adjacently to said cool air discharge openings in a rear part of the body and is tilted backward at a predetermined angle. The blowing fan is disposed in a position near the bottom rear area of the evaporator and blows toward the evaporator to blow cool air produced by the evaporator to the freezing compartment through the air discharge openings. Since the evaporator is disposed near the air discharging openings and the blowing fan blows toward the evaporator, the temperature of the cool air is lowered and then quick freezing is made efficiently.

1 Claim, 3 Drawing Sheets

REFRIGERATOR HAVING QUICK FREEZING FACILITY

BACKGROUND OF THE INVENTION

1. Field of the Invention

The present invention relates to a refrigerator, and more particularly to a refrigerator having quick freezing facility, which improves the efficiency of freezing.

2. Prior Art

A conventional refrigerator which accommodates and freezes or refrigerates foods has, as illustrated in FIG. 1, a body 10 compartmentalized by a partitioning wall 30 to comprise a freezing compartment 11 and a refrigerating compartment 12, an evaporator 22 producing cool air by evaporating liquid refrigerant compressed by compressor (not shown), and a blowing fan 21 providing the freezing compartment 11 and the refrigerating compartment 12 with cool air produced by evaporator 22.

The evaporator 22 is generally disposed behind the freezing compartment 11 in the body 10. The blowing fan 21 is installed at the upper side of the evaporator 22, so as to draw the cool air produced by evaporator 22 and blow it into the freezing compartment 11. Between the freezing compartment 11 and the blowing fan 21, a cool air duct 35 is disposed. At the cool air duct 35, a plurality of cool air discharge openings 26 opened toward the freezing compartment 11 are formed, and the cool air blown into the cool air duct 35 by blowing fan 21 is provided to the freezing compartment 11 through the cool air discharge openings 26. Moreover, a part of the cool air produced by evaporator 22 flows downwardly and is provided to the refrigerating compartment 12.

In the partitioning wall 30, freezing compartment circulating duct 31 which provides a duct for recirculating the cool air provided into the freezing compartment 11, and refrigerating compartment circulating duct 32 which provides a duct for recirculating the cool air provided into the refrigerating compartment 12 to the evaporator 22 are disposed.

However, in such a conventional refrigerator, because the blowing fan 21 is located between the evaporator 22 and the cool air duct 35, there is a problem that the distance between the cool air discharge openings 26 and the evaporator 22 is so long that the efficiency of cooling by cool air is lowered. Generally, the temperature of the cool air produced by the evaporator 22 is extremely low between −33° C. and −31° C. But the temperature of the cool air is elevated between −27° C. and −24° C. while flowing through a long path to be provided toward the interior of the freezing compartment 11 through the cool air discharge openings 26. Furthermore, since the blowing fan 21 draws the cool air from the evaporator 22 to blow it, there is the problem that the blowing power is so weak that the powerful cooling strength cannot be maintained. Therefore, though the users of the refrigerator want quick freezing, the quick freezing capability cannot be carried out.

SUMMARY OF THE INVENTION

The present invention has been produced to overcome the above described problems of the prior art, and accordingly it is an object of the present invention to provide a refrigerator which can minimize the rise in temperature of the cool air produced by the evaporator, and facilitate quick freezing efficiently.

To achieve the above object, the present invention provides a refrigerator including:

a body having a freezing compartment, the freezing compartment having a back wall formed with a plurality of cool air discharge openings;

an evaporator for producing cool air, said evaporator being disposed adjacently to said cool air discharge openings in said body; and a blowing fan disposed at the position near said evaporator for blowing air toward said evaporator and providing said freezing compartment with the cool air from said evaporator through said cool air discharge openings.

It is preferred that said evaporator is disposed behind said freezing compartment.

It is more preferable that said blowing fan is disposed in a position near the bottom rear area of said evaporator.

Furthermore, by causing said evaporator to be tilted backward at a predetermined angle, it is possible to blow uniformly on said evaporator.

Also, by adopting a crossflow fan, the blowing fan is possible to strengthen the blowing flow of air and reduce the noise produced during the operation of the blowing fan.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter the present invention will be described in detail with reference to the drawings.

Figure 1:
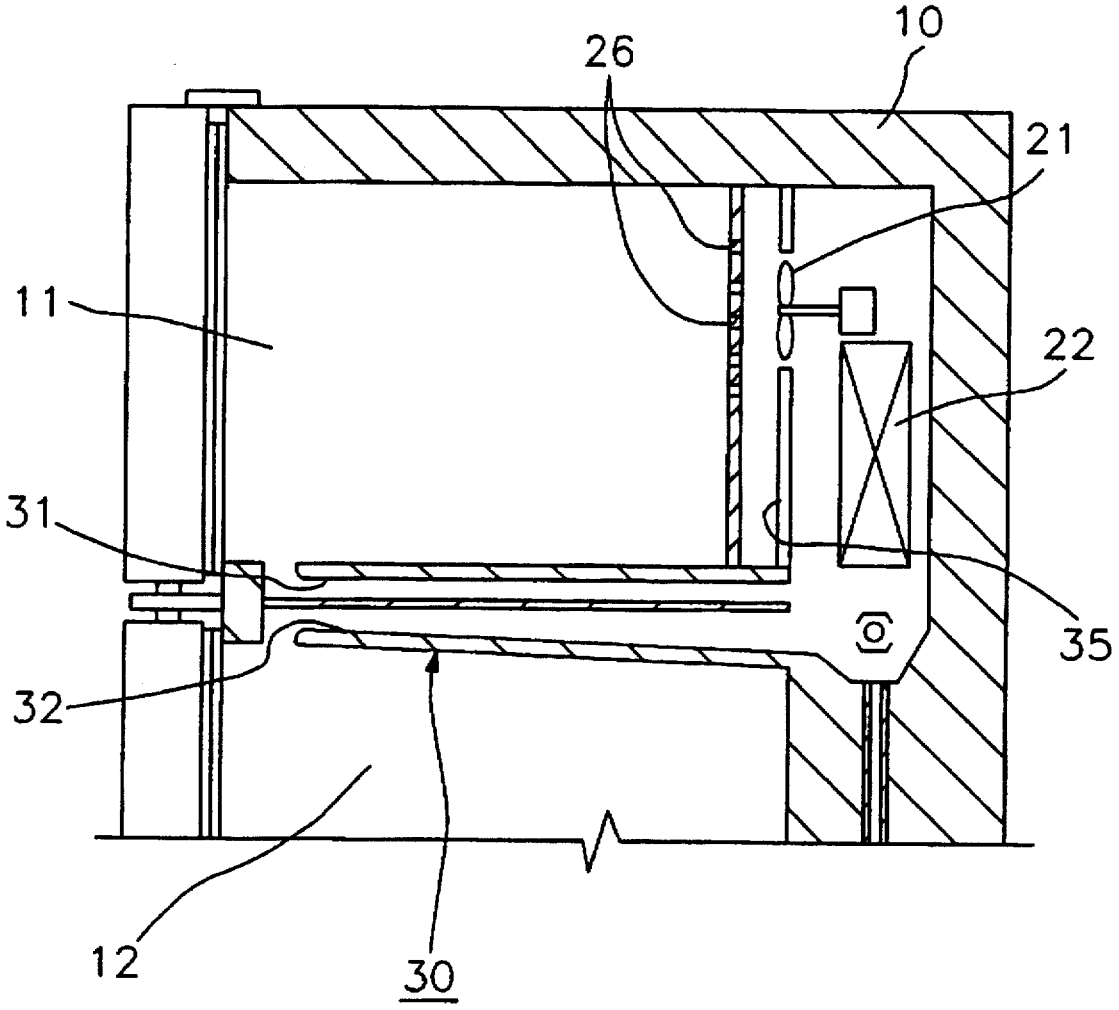
FIG. 1 PRIOR ART
FIG. 1 is a partial sectional elevation view of a conventional refrigerator.
Figure 2:
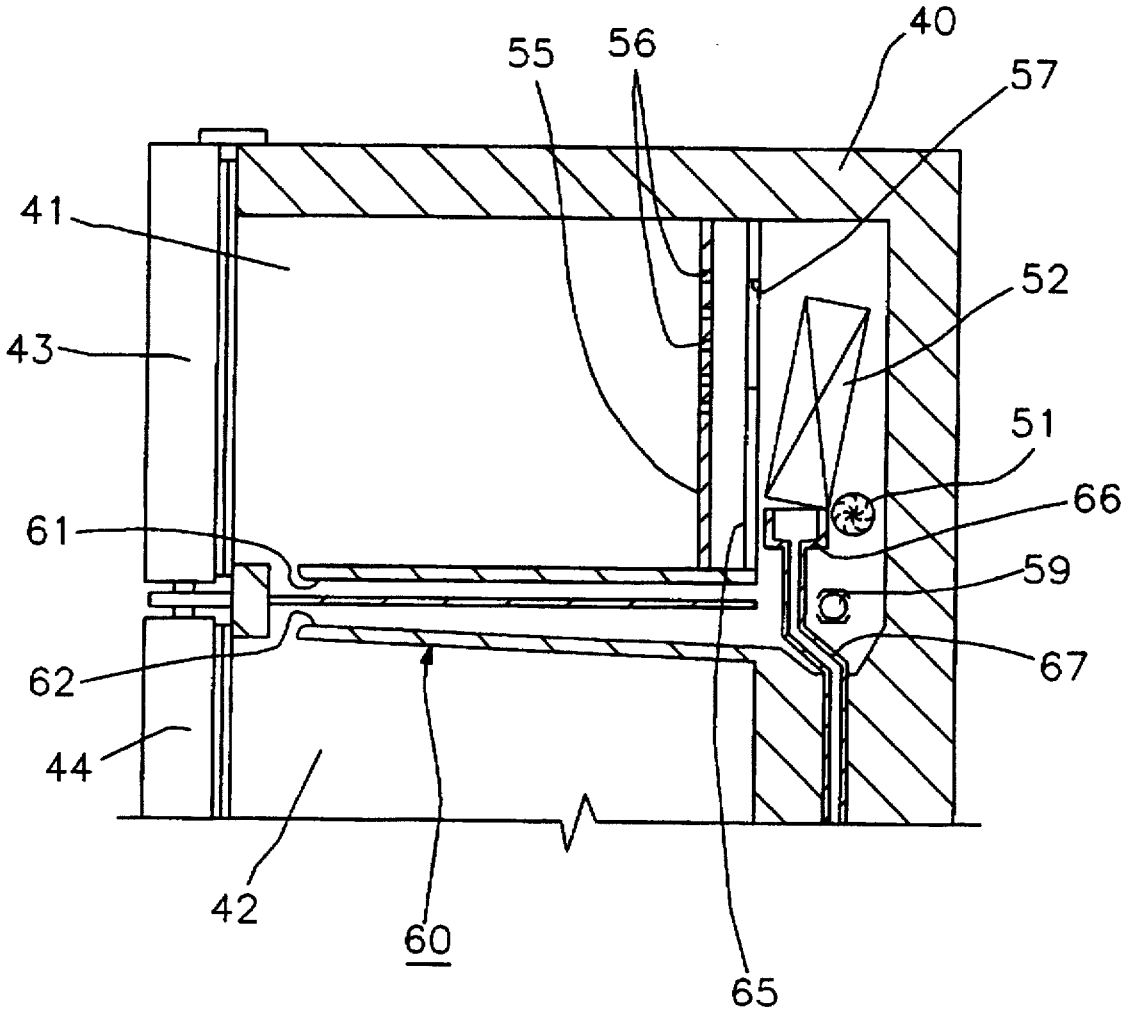
FIG. 2 is a partial sectional elevation view of a refrigerator according to the present invention.
Figure 3:
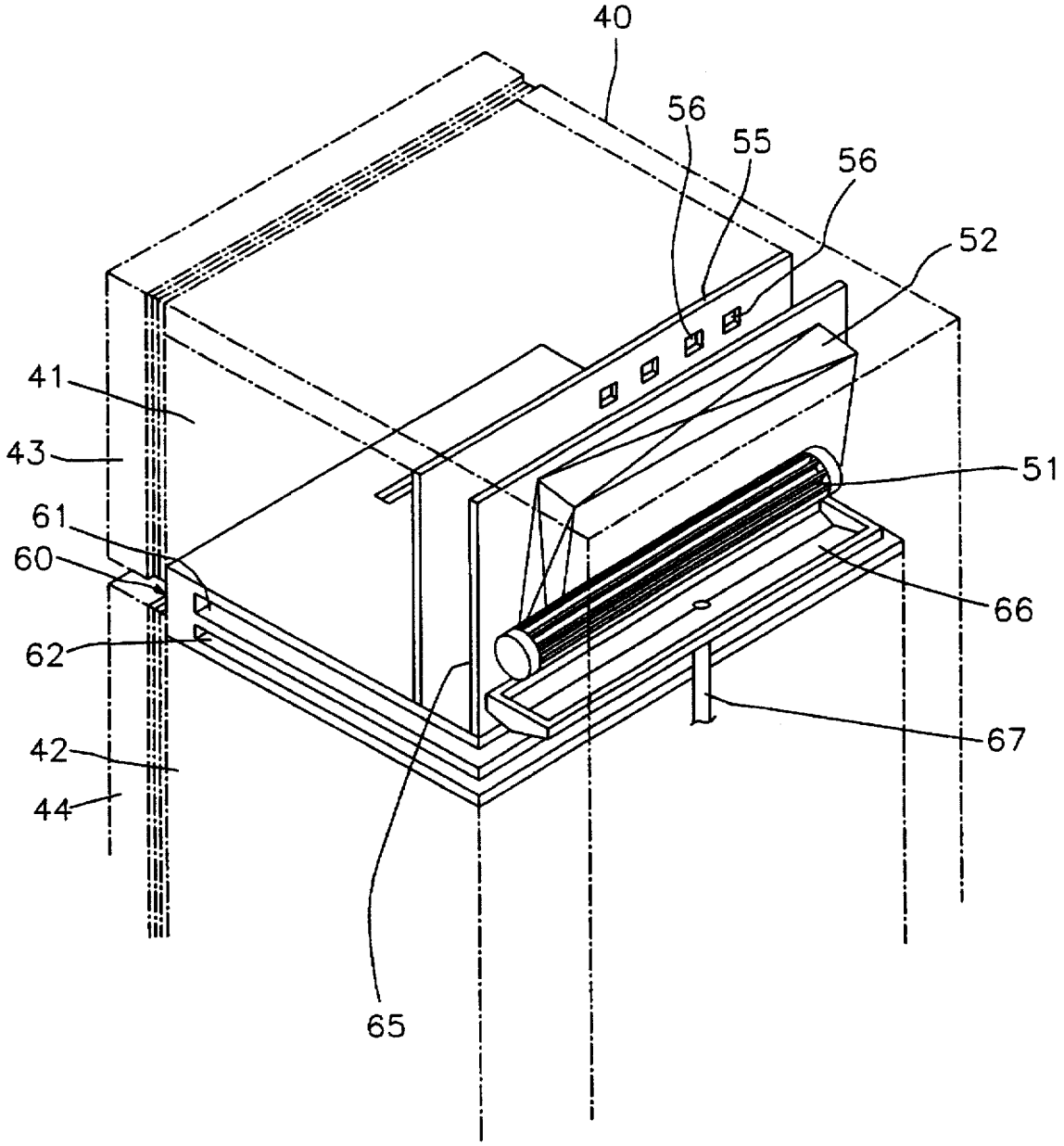
FIG. 3 is a partial rear perspective view of the refrigerator shown in FIG. 2.

FIG. 2 is a partial sectional elevation view of a refrigerator according to the present invention, and FIG. 3 is a partial rear perspective view of the refrigerator shown in FIG. 2. The refrigerator according to the present invention, as described in the conventional reciprocating compressor shown in FIG. 1, has a body 40 compartmentalized by a partitioning wall 60 to comprise a freezing compartment 41 and a refrigerating compartment 42, an evaporator 52 producing cool air by evaporating liquid refrigerant compressed by compressor (not shown), and a blowing fan 51 providing the freezing compartment 41 and the refrigerating compartment 42 with cool air produced by evaporator 22. In the front of the body 40, freezing compartment door 43 which opens and closes the freezing compartment 41 and the refrigerating compartment door 44 which opens and closes the refrigerating compartment 42 are installed.

The evaporator 52 is located behind the freezing compartment 41 in the body 40, and the blowing fan 51 is located in a position near the bottom rear area of the evaporator 52 as to blow in a direction toward the evaporator 52. At the back wall 55 of the freezing compartment 41 a plurality of cool air discharge openings 56 are formed, and between the evaporator 52 and the back wall 55, a cooling air duct 65 which guides cool air from the evaporator 52 to the cool air discharge openings 56 is disposed.

Since the evaporator 52 is located adjacently to the entrance opening 57 of the cool air duct 64 and the blowing fan 51 is located at the lower side behind the evaporator 52, by blowing toward the evaporator 52 the blowing fan 51 provides the cool air duct 65 with the cool air produced by evaporator 52. The evaporator 52 is disposed so that the upper end is tilted backward from the back wall 55 about 15°. Due to tilted positioning of the evaporator 52, the blowing fan 51 blows air over almost all the area of the evaporator 52, and cool air produced by evaporator 52 is smoothly guided to the cool air duct 65. The blow fan 51 consists of a crossflow fan capable of producing abundant blowing at relatively small rotational velocity. A part of the cool air flows downwardly, and is provided in the refrigerating compartment 42.

At a location below the evaporator 52 the defrosting heater 59 is disposed. Defrosting heater 59 performs the defrosting action by heating the evaporator 52. Below the evaporator 52 a defrosting tray 66 is disposed, and to the defrosting tray 66 a defrosting pipe 67 is connected. The defrosting tray 66 accommodates water produced during the defrosting of evaporator 52 by defrosting heater 59, and the water accommodated in the defrosting tray 66 is discharged at a predetermined place through the defrosting pipe 67.

In the partitioning wall 60, a freezing compartment circulating duct 61 and a refrigerating compartment circulating duct 62, which connect inner space of the freezing compartment 41 and the refrigerating compartment 22 with evaporator 52 respectively, are formed. Freezing compartment circulating duct 61 and refrigerating compartment circulating duct 62 provide ducts for recirculating the cool air provided within the freezing compartment 41 and refrigerating compartment 42 to the evaporator respectively.

Hereinafter, the operations and the effects thereby of the refrigerator according to the present invention will be described.

When the refrigerator begins quick freezing, compressor (not shown) begins to compress the refrigerant, and then cool air is produced by the evaporator 52. The blowing fan 51 blows toward the evaporator 52 so as to provide cool air in the cool air duct 65, and then cool air is provided to the freezing compartment 41 through the cool air discharge openings 56. Because the blowing fan 51 is disposed behind the evaporator and blows toward the evaporator 52, the blowing power is stronger than that of the conventional refrigerator as shown in FIG. 1, so the stronger cool air is provided into the freezing compartment 41. Moreover, since the evaporator 52 is disposed at a place near the entrance opening 57 of the cool air duct 65, the distance between the evaporator 52 and cool air discharge openings 56 is reduced. Therefore, air flowing time which would cause an increase in the temperature of the cool air is reduced, and cool air having maximal low temperature, below −30° C., is provided to the freezing compartment 41 and quick freezing is efficiently carried out thereby. Moreover, since the evaporator 52 is tilted so that the upper part thereof is directed backward, the cool air blown by the blowing fan 51 comes in contact with the entire area of the evaporator 52, and the evaporator 52 and the entrance opening 57 are distanced from each other, whereby the cool air generated from the entire area of the evaporator 52 is efficiently guided into the entrance opening 57 for the cool air to be supplied into the freezing compartment 41.

Furthermore, because the crossflow fan is adopted as the blowing fan 51 the amount of blowing becomes more abundant, resulting in more powerful blowing capability. Therefore, the noise produced by driving the blowing fan 51 is reduced.

The air recirculated through the freezing compartment circulating duct 61 and the refrigerating compartment circulating duct 62 is cooled again by the evaporator 52 and blown again to be provided into the refrigerating compartment 4 by the blowing fan 51

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A refrigerator including:

a body having a freezing compartment, the freezing compartment having a back wall formed with a plurality of cool air discharge openings;

an evaporator for producing cool air, said evaporator being disposed adjacently to the cool air discharge openings in a rear of the back wall, an upper part of said evaporator being tilted backward so that a planar direction thereof has a predetermined angle against a planar direction of the back wall; and a crossflow fan disposed at a lower rear area of the evaporator, said crossflow fan for blowing toward the evaporator to supply the cool air to the freezing compartment through the cool air discharge openings.

* * * * *